US008371083B2

(12) United States Patent
Chamberlin et al.

(10) Patent No.: US 8,371,083 B2
(45) Date of Patent: Feb. 12, 2013

(54) RETROFIT ROOF ASSEMBLY

(75) Inventors: Merritt Chamberlin, Kernersville, NC (US); Randall L. Ahland, Kearney, MO (US); Mark Tender, Rowlett, TX (US)

(73) Assignee: BlueScope Buildings North America, Inc., Kansas City, MO (US)

( * ) Notice: Subject to any disclaimer, the term of this patent is extended or adjusted under 35 U.S.C. 154(b) by 0 days.

(21) Appl. No.: 12/895,572

(22) Filed: Sep. 30, 2010

(65) Prior Publication Data

US 2012/0079775 A1 Apr. 5, 2012

(51) Int. Cl.
*E04B 1/74* (2006.01)

(52) U.S. Cl. ..... 52/506.04; 52/506.06; 52/404.1; 52/404.2; 52/404.3; 52/407.1; 52/408

(58) Field of Classification Search ..... 52/407.1–407.5, 52/404.1, 406.1–406.3, 404.2, 404.3, 404.4, 52/404.5, 309.4, 506.04, 506.05, 506.06, 52/408–410, 440, 41, 478–479, 483.1, 90.1–93.2
See application file for complete search history.

(56) References Cited

U.S. PATENT DOCUMENTS

| | | | | |
|---|---|---|---|---|
| 4,058,949 | A * | 11/1977 | Bellem | 52/407.1 |
| 4,099,356 | A * | 7/1978 | Graham | 52/520 |
| 4,329,823 | A * | 5/1982 | Simpson | 52/407.4 |
| 4,406,106 | A * | 9/1983 | Dinges | 52/478 |
| 4,516,371 | A | 5/1985 | Simpson | |
| 4,573,298 | A * | 3/1986 | Harkins | 52/404.3 |
| 4,597,234 | A * | 7/1986 | Simpson | 52/478 |
| 4,619,100 | A * | 10/1986 | Emblin | 52/748.1 |
| 4,651,489 | A * | 3/1987 | Hodges et al. | 52/409 |
| 5,142,838 | A | 9/1992 | Simpson et al. | |
| 5,303,528 | A | 4/1994 | Simpson et al. | |
| 5,367,848 | A | 11/1994 | McConnohie | |
| 5,473,847 | A * | 12/1995 | Crookston | 52/302.1 |
| 5,685,118 | A | 11/1997 | Simpson | |
| 5,692,352 | A | 12/1997 | Simpson | |
| 5,697,197 | A | 12/1997 | Simpson | |
| 5,704,170 | A | 1/1998 | Simpson | |
| 5,737,894 | A | 4/1998 | Simpson et al. | |
| 5,857,292 | A | 1/1999 | Simpson | |
| 7,174,686 | B1 | 2/2007 | Legband | |
| 2005/0086872 | A1 * | 4/2005 | Fligg | 52/41 |
| 2010/0275525 | A1 * | 11/2010 | Wendelburg et al. | 52/90.2 |

FOREIGN PATENT DOCUMENTS

WO 2009/154996 A2 12/2009

* cited by examiner

*Primary Examiner* — Jeanette E. Chapman
(74) *Attorney, Agent, or Firm* — Lathrop & Gage LLP

(57) ABSTRACT

Disclosed is a retrofit arrangement for securing a new roof structure above an already existing roof structure. The system uses thermal blocks placed crosswise between the ribs on the existing roof structure. Above a series of these thermal blocks, a longitudinal support strip is provided onto which a plurality of clips can be fastened. The blocks provide thermal resistance, and enable a reduction in number of fasteners required for assembly.

13 Claims, 2 Drawing Sheets

RETROFIT ROOF ASSEMBLY

CROSS-REFERENCE TO RELATED APPLICATIONS

[None]

STATEMENT REGARDING FEDERALLY SPONSORED RESEARCH OR DEVELOPMENT

[None]

BACKGROUND OF THE INVENTION

1. Filed of the Invention

The invention relates generally to the field of providing roofing structures for metal buildings. More specifically, the present invention relates to metal roofing retrofit arrangements.

2. Description of the Related Art

It is known in the art to install a new metal roof on top of an existing metal roof structure. For example, in U.S. Pat. No. 5,367,848 issued to McConnohie, an arrangement is disclosed which is adapted for installation onto an existing metal roof which has a number of ribs which run up and down the roof slope. McConnohie accommodates the ribs on the roof surface by creating a custom bracket which runs crosswise the ribs. The bottom of this bracket is used to be fixed on top of the existing roof structure with two fasteners between each rib. The bracket has a web that extends upward to a supporting shelf on top of which the new roof structure will be bolted, also requiring relatively closely spaced bolts.

In order to accommodate the ribs, McConnohie has included reciprocating notches on the lower portions of the bracket. The ribs pass crosswise through these notches. This enables the new roof to be secured over the existing roof structures when a plurality of the configured brackets are spaced apart in parallel to one another, again, running perpendicular relative to the ribs on the existing roof.

SUMMARY OF THE INVENTION

The scope of the present invention is intended to be determined by the claims set forth in later section.

In embodiments, the disclosed system includes the use of block members which are arranged crosswise relative to the ribs on an existing roof structure and are utilized to provide a supporting surface for clips and other structures to enable the retrofitting of a new roof structure above the existing roof structure.

The retrofit roof assembly, in embodiments, is mounted over the existing purlins and roof panels. In embodiments the blocks are made of an insulative material, e.g., foam board insulation and a longitudinal sheet metal platform serves as the supporting surface for the clips.

DETAILED DESCRIPTION OF THE DRAWINGS

The disclosed system, in embodiments, incorporates thermally-resistant blocks for support purposes. These blocks, in embodiments, span between ribs on the existing roof structures to provide support for a sheet metal member which either clears or rests atop each rib. This mounting arrangement has proven to provide advantages over the prior art retrofit practices.

For example, the prior art systems like those used by McConnohie are less thermally efficient than those used herein. The brackets used have vertical webs which support and displace the existing and new roof structures, but also create a thermal energy shunt. This enables undesirable heat transfer between the existing and new roof. And avoiding this sort of energy loss has become more and more important.

Another disadvantage in the McConnohie types of arrangements is that assembly time is significant. One reason this is so is that the number of fasteners required to give the bracket the necessary integrity, e.g., two screws between each rib, and two closely spaced screws securing the new roof structures to the top platform of the bracket, greatly slows down the construction process.

Figure 1:
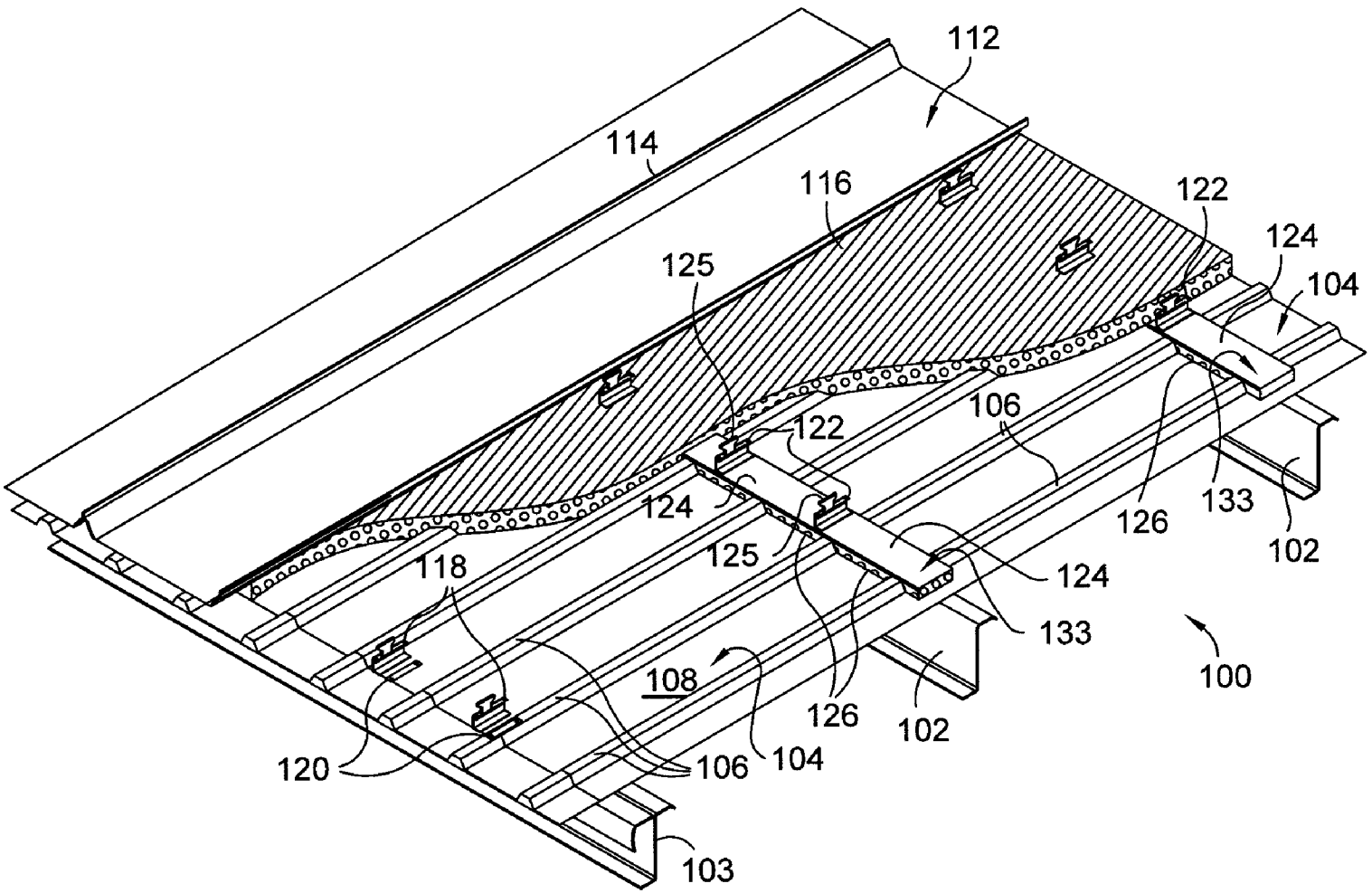
FIG. 1 shows a view of the disclosed system in perspective with a forward portion of the new roof structure and blanket insulation removed to reveal the support structures for the system.
Figure 2:
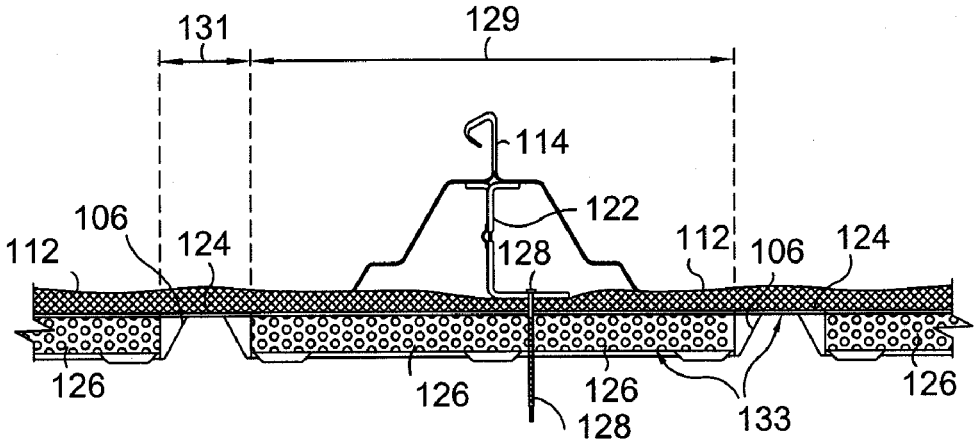
FIG. 2 is a cross-sectional view taken at a section 2-2 from FIG. 1 showing the thermal block of the disclosed system from the side.
Figure 3:
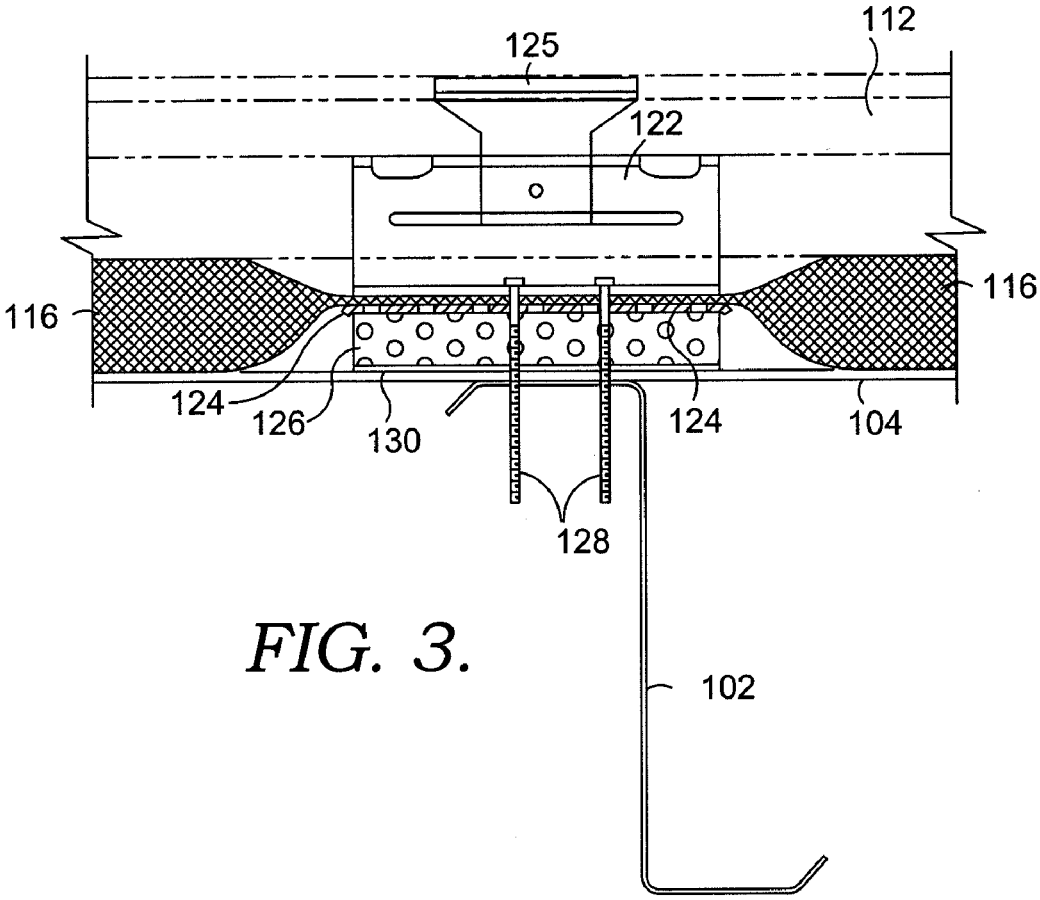
FIG. 3 taken from section 3-3 in FIG. 2 shows the thermal block structures from the end.

The systems disclosed herein overcome these, as well as many other disadvantages existing in the prior art. An embodiment of the system of the present invention is shown in FIGS. 1-3. Referring first to FIG. 1, a roof assembly 100 is shown which is able to be retrofit on top of existing roof structures. A typical existing roof 104 is supported by a plurality of Z-Purlins 102 and slopes down to terminate near an eave support 103. It should be noted that many different metal roofing structures exist, or did exist on the market which will be encountered by the reroofing organization. Those skilled in the art will recognize that the system and methods employed herein could be used in retrofitting most of these structures regardless of rib height or seam configuration by modifying component sizes, etc.

For the example provided, which is a standing-seam roof 104, a plurality of ribs 106 on the existing roof become a problem to the technician in that a newly installed roof must be secured to it despite the protruding ribs 106. From the figures, it can be seen that a trough 108 is defined between each of the ribs 106 on the roof 104.

A reroof panel 112 will be installed on top of existing roof 104 as shown. The ribs 114 on the reroof structure 112 come to a ridge point. Some of the ridges comprise a seam as will be known to those skilled in the art. Underneath reroof 112, blanket insulation 116 will be disposed. Clips will be installed at the eaves 120 either on a stand-off zee clip or atop a sheet metal platform, and at each purlin 102. The clips at the purlins 102 can be seen in FIGS. 1-3 as resting atop a sheet metal platform 124. A foam board support block 126 and a fastener pair 128 (see FIG. 3) are used to support the clips 122 above the purlins 102.

The details regarding the spacer block 126 can best be seen in FIGS. 2 and 3. In embodiments, the spacer blocks 126 are made from foam board insulation. The foam board insulation provides the rigidity required for support purposes, but also acts as a good insulator, which makes it desirable. In other embodiments, however, spacer blocks 126 could be constructed of other insulative materials such as composite boards, expanded polystyrene, extruded polystyrene or polyisocyanurate so long as the material selected has the desired structural integrity.

In terms of the construction process, it is initially presumed that the existing roof structure is similar to that disclosed in FIG. 1. It should be pointed out, however, that this process would be useful with any sort of roof, for example, the processes herein can be used for mounting over numerous commercially available roofing structures which have rib-like structures in parallel atop the roof, e.g., standing seam, trapezoidal, corrugated, R-panel, channel drain or snap seamed panel systems.

As a preliminary step, it is presumed that the user will have desired clip spacing's and other dimensional aspects regarding the requirements for assembling and supporting the new roofing structures to be installed worked out in advance of beginning the process.

As a next step, the user contemplates the dimensional aspects of the existing roof structures 108, and pre-assembles the blocks 126 to the longitudinal metal sheets 124 so that the assembled part can be mounted on the existing roof 108 to support the new roof. Before assembling, however, the width 131 of each rib 106 and the dimension 129 between each rib must be measured or otherwise known from model type, or reference information. Once dimension 129 (the space between each rib) is known, the blocks 126 are cut to that length. Then, the cut and sized blocks 126 are adhered to the longitudinal sheet metal strip 124 to create a modular strip 133. The blocks 126 can be secured using an adhesive, fasteners, or some other method. In the preferred embodiment, an adhesive is used. Also in the preferred embodiment, the metal strip and blocks are assembled at the factory, although it is entirely possible that they would be assembled on the worksite or elsewhere. Regardless, once the foam blocks 126 have been adhered in a spaced relationship onto the metal strip 124, the combined device 133 is able to, when laid block down on the existing roof, to accommodate the rib spacing already existing, e.g., ribs 106. FIGS. 1 and 2. show the modular strips already in place.

Although FIG. shows an embodiment where a film 130 of mastic used to hold the block 126 in place, in many cases mastic is not necessary. This is because of the clip 122 fastening arrangement. The long length clip fasteners 128, once screwed in, will alone hold the modular strip in place. Thus, in many embodiments, the mastic 130 would be completely absent. In other embodiments, only a dab of mastic would be used to temporarily hold the modular strip in place prior to the screwing in of the fasteners. As can be seen in FIG. 2 that the block ends are cornered off. It is also possible, however, that the block ends could be cut to match with the sloped lateral surfaces of the ribs 106. Regardless, the combined device/modular strip 133, when installed blocks-down over the existing roof, the metal strip 124 will be a supporting surface above each purlin 102 which can also, because it is metal, be screwed or otherwise fastened into. As can be seen in FIGS. 1-3, the blocks 126 and metal strip 124, once installed, run perpendicular relative to the ribs 106 on the existing roof structures.

Once the modular strips 133 are all laid out onto the roof in a spaced apart relationship, and being substantially parallel relative to one another (see, e.g., the two modular strips 133 shown in FIG. 1) the clips 122 are each then positioned in the desired locations, and fastener pairs 128 are used to secure each clip 122 into place.

The fasteners 128 can be aided in installation by pre-drilling holes. In the disclosed embodiment, the base of each clip 122 has predrilled holes for the fasteners 128. It is also possible, however, that the sheet metal platform 124, and foam board spacer blocks 126 also include predrilled holes for making positioning easier. This is not absolutely necessary, however, because the foam board insulation and other materials are able to receive the fasteners through it easily enough. The fasteners used are normally metal roof screws as is known to those skilled in the art, but in other embodiments, bolts, nails, adhesives, or other fastening methods might be used.

Once the fasteners 122 have been secured, insulation 116 is then laid out as shown in FIG. 1. Although blanket insulation is shown being used in the embodiments depicted, one skilled in the art would recognize that rigid or other forms of insulation might be used instead depending on the space created.

Even though the insulation is in place, the upper portions 125 of the clips 122 are able to extend up and through the insulation sheet. These upper portions 125, in the embodiment shown in FIGS. 1-3, the clips are the sort having upper portions 114 which are easily seamed into a roof using known technologies. This can be seen, e.g., in U.S. Pat. No. 4,651,489 issued to Hodges et al., the contents of which are herein incorporated by reference.

The arrangements disclosed herein enable a reduction in the number of fasteners than required by the McConnohie and other prior art techniques. Because only two fasteners are required at each clip, the processes herein are more efficient than McConnohie. McConnohie uses two tiers of fasteners—one tier for securing the lower flange of the spacer bracket to the existing roof and an upper portion of the supporting Z-purlin—and a second tier of fasteners to secure the new roof onto an upper flange of the bracket. Additionally, installing the McConnohie bracket sometimes involves securing fasteners from awkward positions.

Another advantage to using the blocks 126 of the embodiment disclosed in FIGS. 1-3 is due to their role as an insulator against thermal conductivity. This prevents undesirable heat transfer because the clips 122 are not shunted through the new retrofit roof structures to prevent thermal losses. The McConnohie brackets, contrarily, act as a heat transfer shunt, increasing the heat transfer through the roofing structures.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A retrofit roof assembly for installation onto an existing roof structure mounted over purlins, said existing roof structure including a plurality of upwardly extending ribs, each rib being substantially parallel to the next, a plurality of trough areas defined between each opposing rib, the retrofit assembly comprising:

a plurality of structurally supporting rigid insulative blocks disposed crosswise between each opposing set of ribs, the insulative blocks being located above the purlins beneath the existing roof structure;

a longitudinal platform resting on top of said blocks and spanning said ribs creating a supporting surface for a new roof structure.

2. The assembly of claim 1 wherein each of the blocks is comprised of foam board insulation.

3. The assembly of claim 1 wherein said longitudinal platform is comprised of sheet metal.

4. The assembly of claim 1 wherein a plurality of clips are mounted on top of said longitudinal platform, said clips including an upper portion adapted to be received within a roof seam.

5. The assembly of claim 1 wherein the clips, blocks, and longitudinal platform are all secured through the existing roof structure using the same fasteners.

6. A system used for the purpose of supporting a plurality of clips atop an existing roof structure, said existing roof structure having a ribbed surface, the system comprising:

a plurality of structurally supporting blocks disposed between the ribs, each of the blocks being constructed of a thermally insulating material; and a platform placed atop the blocks, the platform serving to expand over and across the ribs to provide a supporting surface for said clips.

7. The system of claim 6 wherein the blocks, a blanket of insulation, and a bottom portion of the clip are all penetrated by at least one fastener to secure the entire assembly to the existing roof structure.

8. The system of claim 6 wherein the blocks are disposed between the ribs and are perpendicular to the ribs while at the same time being substantially parallel to a roof purlin beneath the existing roof.

9. A method of retrofitting a new roof to an existing roof, the method comprising:

(i) sizing a plurality of blocks such that they are able to fit crosswise between a plurality of ribs on the existing structure and have a thickness such that a top of each block is at the level of a top of each rib;

(ii) providing a longitudinal strip member;

(iii) causing the blocks to be placed on the roof so that they are in line over a purlin and the longitudinal strip is above an upwardmost extending top part of each of the ribs and the longitudinal strip spans crosswise over an adjacent pair of ribs;

(iv) fixing a plurality of clips along the top of the longitudinal structure; and (v) seaming the clips into a reroof structure above the existing roof.

10. The method of claim 9 comprising:

initially securing the blocks to the strip before placing them on the existing roof.

11. The method of claim 10 comprising:

driving fasteners through each clip through the strip then through a block located below the clip, then into an upper portion of the purlin to secure the blocks, strip and clip to the existing roof structures.

12. The method of claim 9 comprising:

constructing the blocks out of an insulative material.

13. The method of claim 12 comprising:

selecting foam board insulation to serve as said material the blocks are constructed of.

* * * * *